US008814594B2

(12) United States Patent
Miyazaki

(10) Patent No.: US 8,814,594 B2
(45) Date of Patent: Aug. 26, 2014

(54) ELECTRICAL CONNECTOR HAVING ROTATION PREVENTION FUNCTION

(71) Applicant: Hirose Electric Co., Ltd., Tokyo (JP)

(72) Inventor: Atsuhiro Miyazaki, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 9 days.

(21) Appl. No.: 13/681,915

(22) Filed: Nov. 20, 2012

(65) Prior Publication Data

US 2013/0137282 A1 May 30, 2013

(30) Foreign Application Priority Data

Nov. 25, 2011 (JP) ..... 2011-257070

(51) Int. Cl.
*H01R 13/648* (2006.01)
*H01R 12/77* (2011.01)
*H01R 12/55* (2011.01)
*H01R 12/79* (2011.01)

(52) U.S. Cl.
CPC ..... *H01R 12/55* (2013.01); *H01R 12/775* (2013.01); *H01R 12/79* (2013.01)
USPC ..... 439/607.01; 439/260

(58) Field of Classification Search
CPC ..... H01R 23/7073; H01R 13/65802; H01R 13/6658; H01R 23/725; H01R 12/79; H01R 12/775; H01R 12/707; H01R 12/61; H01R 12/62; H01R 13/6594; H01R 23/6873; H01R 23/688
USPC ..... 439/260, 495–497, 607.01, 607.07, 439/607.09, 607.11, 607.13, 607.31, 439/607.32, 607.35, 607.36, 660
See application file for complete search history.

(56) References Cited

U.S. PATENT DOCUMENTS

| | | | | |
|---|---|---|---|---|
| 5,738,545 | A * | 4/1998 | Igarashi et al. | 439/607.36 |
| 6,066,000 | A * | 5/2000 | Masumoto et al. | 439/607.34 |
| 6,231,378 | B1 * | 5/2001 | Wu et al. | 439/495 |
| 7,354,300 | B2 * | 4/2008 | Shindo | 439/497 |
| 7,674,134 | B2 * | 3/2010 | Yamaji et al. | 439/607.53 |
| 7,766,680 | B2 * | 8/2010 | Suzuki et al. | 439/260 |
| 7,934,957 | B1 * | 5/2011 | Nakajima et al. | 439/607.49 |
| 8,241,069 | B2 * | 8/2012 | Yamaji | 439/660 |
| 8,608,509 | B2 * | 12/2013 | Shimada et al. | 439/607.01 |

FOREIGN PATENT DOCUMENTS

JP 2009-199891 A 9/2009

* cited by examiner

*Primary Examiner* — Thanh Tam Le
(74) *Attorney, Agent, or Firm* — Kubotera & Associates, LLC

(57) ABSTRACT

An electrical connector is configured to be mounted on a board. The electrical connector includes a housing having a receptacle opening portion for receiving a mating connector; a terminal member disposed in the housing; and a shell member for covering the housing. The terminal member includes a base portion fixed to the housing, an arm portion extending from the base portion toward the receptacle opening portion, a contact portion disposed at a distal end portion of the arm portion, a board connecting portion, and a rotation preventing portion extending from the board connecting portion toward the receptacle opening portion. The shell member includes a shell receiving portion extending toward the base portion. The housing includes an insertion portion disposed between the rotation preventing portion and the shell receiving portion.

7 Claims, 9 Drawing Sheets

ELECTRICAL CONNECTOR HAVING ROTATION PREVENTION FUNCTION

BACKGROUND OF THE INVENTION AND RELATED ART STATEMENT

The present invention relates to an electrical connector. More specifically, the present invention relates to an electrical connector for connecting a plurality of electrical cables to a wiring portion on a print circuit board.

In general, an electrical device such as a personal computer, a mobile electrical device, and the like is provided with a large number of electrical components. For example, an LSI (a Large Scale Integrated circuit), other passive components, and the like are mounted on a print circuit board. Accordingly, it is necessary to provide an electrical connector for connecting the print circuit board, a liquid crystal display, an RF circuit, and the like. When a size or a thickness of the electrical device is reduced, it is necessary to reduce a size or a thickness of the electrical connector accordingly, while it is necessary to maintain high reliability such as rigidity, durability, and the like.

Patent Reference has disclosed a conventional electrical connector for connecting a plurality of electrical cables to a wiring portion on a print circuit board. The conventional electrical connector disclosed in Patent Reference includes a receptacle connector and a plug connector, so that the receptacle connector (also referred to as a board side connector) is connected to the plug connector.

Patent Reference: Japanese Patent Publication No. 2009-199891

In the conventional electrical connector disclosed in Patent Reference, the plug connector includes a plurality of plug connector contact portions made of a metal, a plug connector side holding member made of an insulation material for holding the plug connector contact portions, and a shell member made of a metal for covering the plug connector side holding member. Further, the plug connector is configured such that the plug connector contact portions are connected to a coaxial cable.

In the conventional electrical connector disclosed in Patent Reference, the receptacle connector includes a plurality of receptacle connector contact portions made of a metal, a receptacle connector side holding member made of an insulation material for holding the receptacle connector contact portions, and a shell member made of a metal for covering the receptacle connector side holding member. Further, the receptacle connector is configured such that a lower portion of the receptacle connector contact portions is electrically connected to a signal circuit pattern on the print circuit board with solder and the like.

In the conventional electrical connector disclosed in Patent Reference, the plug connector is connected to the receptacle connector such that a plug protruding portion of the plug connector is inserted into a receptacle connector side space (also referred to as an insertion opening). Accordingly, upper surface contact portions of the plug connector contact portions of the plug connector contact with and electrically connected to contact portions formed at distal end portions of arm portions of the receptacle connector contact portions of the receptacle connector.

As described above, in the conventional electrical connector disclosed in Patent Reference, when the plug connector is fitted into and connected to the receptacle connector, the plug protruding portion of the plug connector is inserted into the receptacle connector side space. Accordingly, the plug connector contact portions of the plug connector contact with and electrically connected to the receptacle connector contact portions of the receptacle connector. At this moment, the contact portions and the arm portions of the receptacle connector side contact portions are deformed upwardly. Accordingly, a rotational moment is generated upwardly in the receptacle connector side contact portions.

In the conventional electrical connector disclosed in Patent Reference, when the rotational moment is generated upwardly in the receptacle connector side contact portions, the receptacle connector side contact portions may be rotated. When the receptacle connector side contact portions are rotated, it is possible to damage on solder connecting portions between the receptacle connector side contact portions and the signal circuit pattern on the print circuit board, thereby causing a problem such as poor electrical connection. Further, when the receptacle connector side contact portions are rotated, the conventional electrical connector may be deformed in a height direction thereof, thereby increasing an entire mounting height thereof.

In view of the problems described above, an object of the present invention is to provide an electrical connector for connecting a plurality of electrical cables and a wiring portion on a print circuit board. In the electrical connector of the present invention, it is possible to absorb a rotational moment applied to a contact portion (a terminal member) of a board side connector when the electrical connector is connected.

Further objects and advantages of the invention will be apparent from the following description of the invention.

SUMMARY OF THE INVENTION

In order to attain the objects described above, according to a first aspect of the present invention, an electrical is configured to be mounted on a board. The electrical connector is further configured to be connected to a mating connector when a fitting portion of the mating connector is inserted into a receptacle opening portion of the electrical connector.

According to the first aspect of the present invention, the electrical connector includes a housing having the receptacle opening portion for receiving the mating connector; a terminal member disposed in the housing for contacting with a terminal of the mating connector so that the terminal member is electrically connected to the terminal; and a shell member with electrical conductivity for covering an outer circumference of the housing.

According to the first aspect of the present invention, the terminal member includes a base portion tightly fitted into and fixed to the housing, an arm portion extending from one side of the base portion toward the receptacle opening portion, a contact portion disposed at a distal end portion of the arm portion, a board connecting portion disposed on the other side of the base portion, and a rotation preventing portion extending from the board connecting portion toward the receptacle opening portion.

According to the first aspect of the present invention, the shell member includes a shell receiving portion extending from a side of the receptacle opening portion toward the base portion at a bottom portion of the shell member. The shell receiving portion is configured to be tightly fitted into the housing. The shell receiving portion is disposed between the contact portion of the terminal member and the rotation preventing portion. The housing includes a part (an insertion portion) disposed in a contact state between the rotation preventing portion and the shell receiving portion.

As described above, according to the first aspect of the present invention, the electrical connector is provided with the part (the insertion portion) of the housing, the rotation preventing portion, and the shell receiving portion. Accordingly, it is possible to absorb a rotational moment applied to the terminal member of the board side connector when the electrical connector is connected to the mating connector, thereby preventing the terminal member from being rotated.

According to a second aspect of the present invention, in the electrical connector according to the first aspect, the shell receiving portion may have a distal end portion situated closer to the base portion relative to a distal end portion of the rotation preventing portion. Further, the distal end portion of the shell receiving portion is situated closer to the arm portion relative to the distal end portion of the rotation preventing portion. Accordingly, it is possible to absorb the rotational moment applied to the terminal member of the board side connector more effectively, thereby more effectively preventing the terminal member from being rotated.

According to a third aspect of the present invention, in the electrical connector according to first aspect, wherein said shell receiving portion may be arranged to cover the terminal member and an adjacent terminal member situated adjacent to the terminal member or all terminal members along a longitudinal direction of the electrical connector. Accordingly, it is possible to firmly fix the shell receiving portion, thereby more effectively preventing the terminal member from being rotated.

According to a third aspect of the present invention, in the electrical connector according to the first aspect, the board connecting portion may be configured to be soldered to a wiring portion of the board. Alternatively, instead of solder, the board connecting portion may be connected to the board with a conductive adhesive, a conductive paste, and the like.

According to a third aspect of the present invention, in the electrical connector according to the first aspect, the rotation preventing portion may be configured to be soldered to a wiring portion of the board. Accordingly, it is possible to securely connect the terminal member to the wiring portion of the board, and securely prevent the terminal member from being rotated.

According to the present invention, the electrical connector is provided with the part (the insertion portion) of the housing, the rotation preventing portion, and the shell receiving portion. Accordingly, it is possible to absorb a rotational moment applied to the terminal member of the board side connector when the electrical connector is connected to the mating connector, thereby preventing the terminal member from being rotated.

DETAILED DESCRIPTION OF THE PREFERRED EMBODIMENTS

Figure 1:
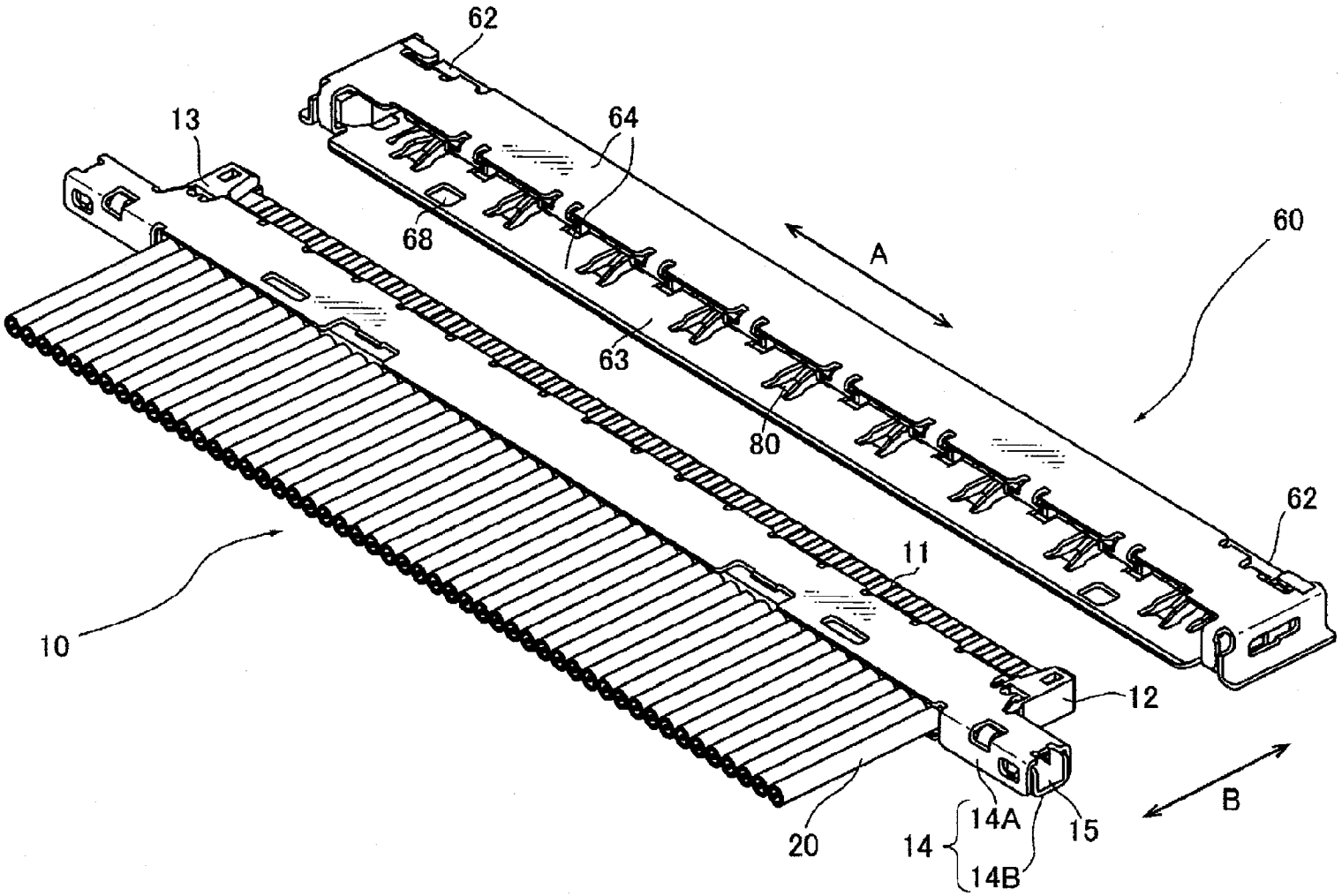
FIG. 1 is a perspective view showing a receptacle connector (an electrical connector) and a plug connector (a mating connector) in a state before the receptacle connector is connected to the plug connector according to an embodiment of the present invention.

Hereunder, embodiments of the present invention will be explained with reference to the accompanying drawings. In the accompanying drawings, similar components are designated with the same reference numerals, and repeated explanations thereof are omitted.

Figure 2:
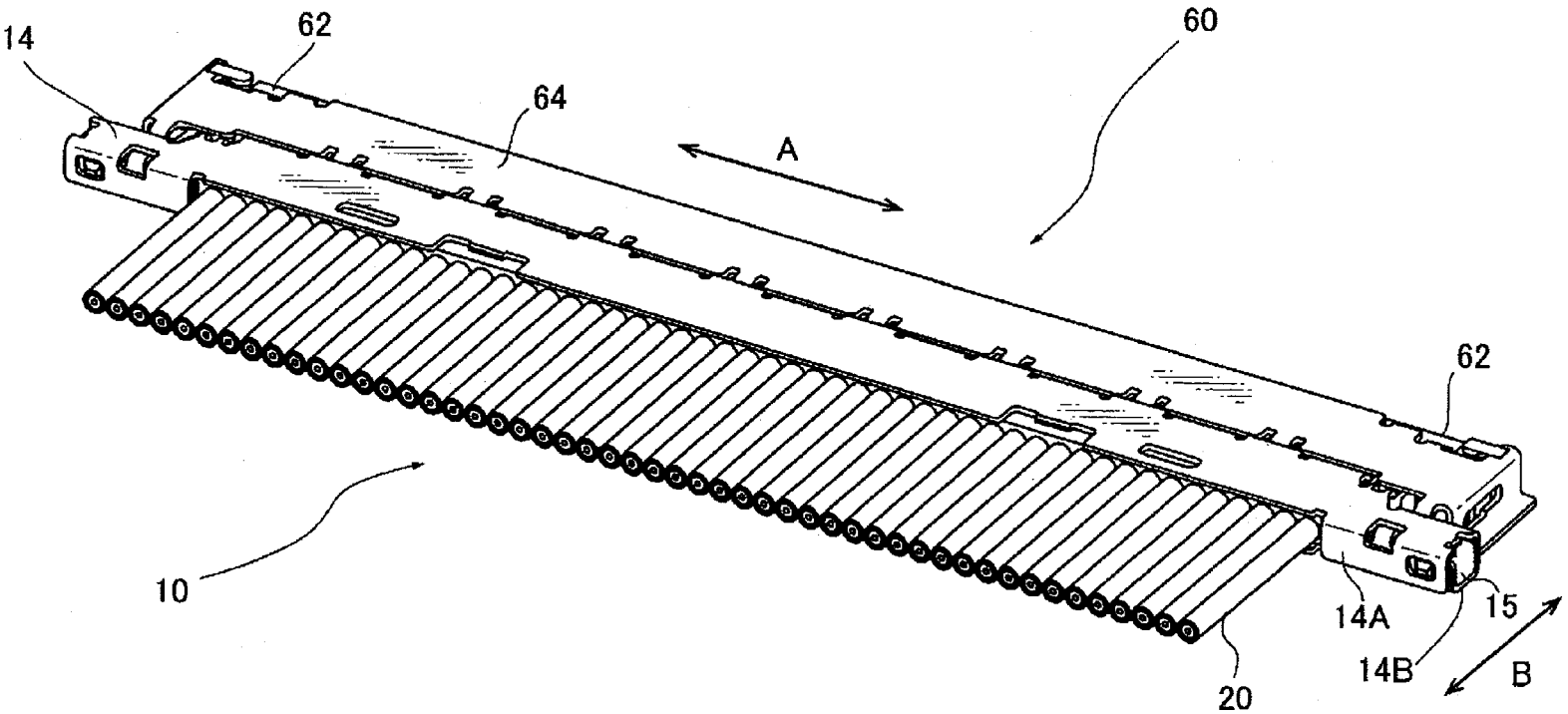
FIG. 2 is a perspective view showing the receptacle connector and the plug connector in a state after the receptacle connector is connected to the plug connector according to the embodiment of the present invention.
Figure 3:
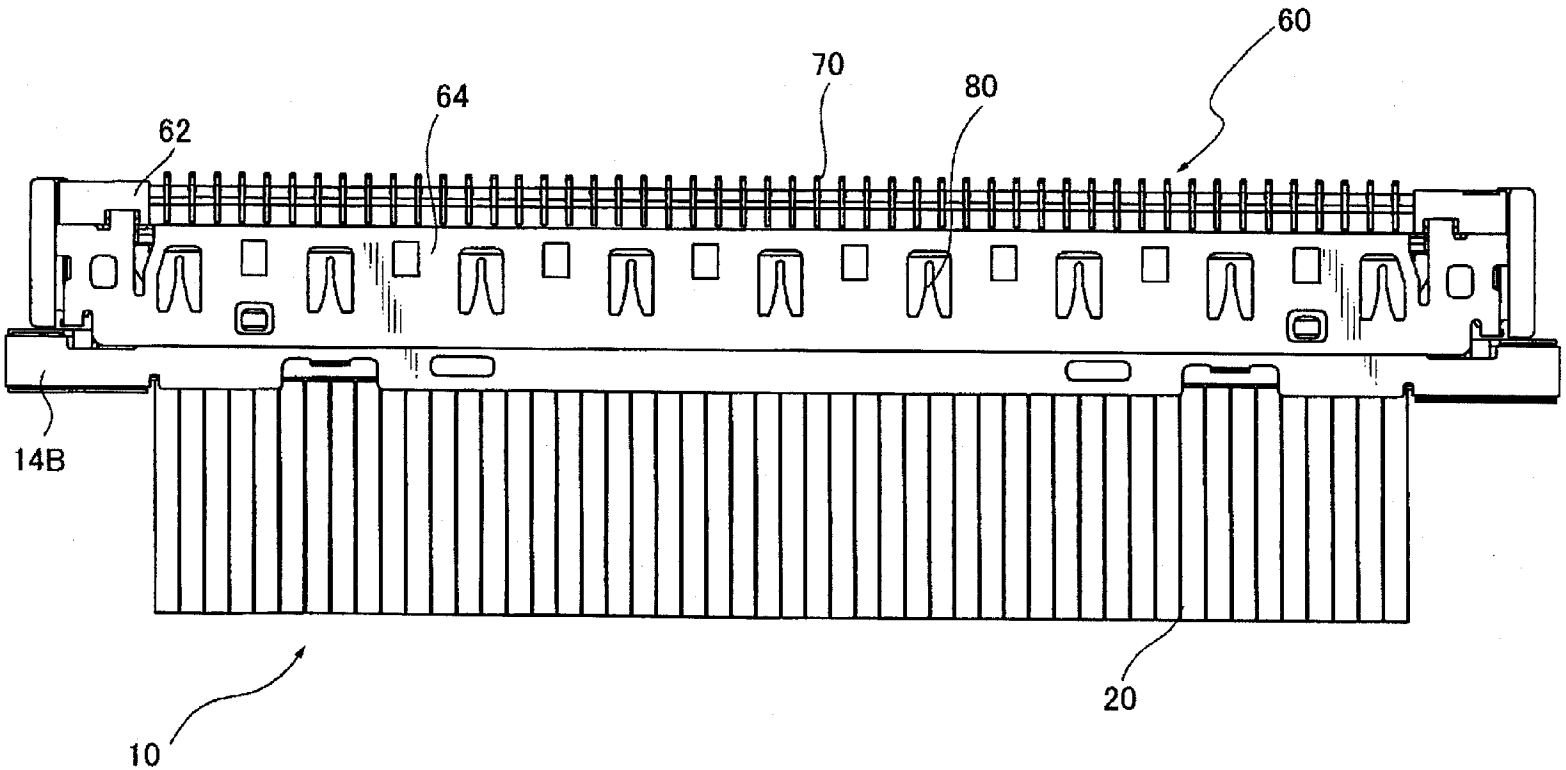
FIG. 3 is a bottom view showing the receptacle connector and the plug connector in the state after the receptacle connector is connected to the plug connector and viewed from a side of a board according to the embodiment of the present invention.

FIG. 1 is a perspective view showing a receptacle connector 60 (an electrical connector) and a plug connector (a mating connector) in a state before the receptacle connector 60 is connected to the plug connector 10 according to an embodiment of the present invention. FIG. 2 is a perspective view showing the receptacle connector 60 and the plug connector 10 in a state after the receptacle connector 60 is connected to the plug connector 10 according to the embodiment of the present invention. FIG. 3 is a bottom view showing the receptacle connector 60 and the plug connector 10 in the state after the receptacle connector 60 is connected to the plug connector 10 and viewed from a side of a board according to the embodiment of the present invention. Configurations of the receptacle connector 60 and the plug connector 10 will be explained with reference to FIGS. 1 to 3.

As shown in FIGS. 1 to 3, the receptacle connector 60 and the plug connector 10 include a plurality of contact members (terminal members) 11 and contact members (terminal members) 70, respectively. In order to electrically connect the contact members 11 and the contact members 70, the receptacle connector 60 is fitted into the plug connector 10 in use.

In the embodiment, the plug connector 10 is configured as a cable side connector, so that a plurality of electrical cables 20 can be attached to the plug connector 10 on a side opposite to a side of the plug connector 10 connected to the receptacle connector 60. Further, the receptacle connector 60 is configured as a board side connector, so that the receptacle connector 60 can be mounted on a print circuit board (not shown) in use.

As shown in FIG. 1, the plug connector 10 and the receptacle connector 60 extend in a longitudinal direction A (a pitch direction of the contact members 11 and the contact members 70) perpendicular to a fitting direction B. Further, the plug connector 10 and the receptacle connector 60 have right-to-left symmetrical shapes in the longitudinal direction A.

In the embodiment, the plug connector 10 mainly includes the contact members 11; a housing 12 with insulation property for holding the contact members 11; and a metal shell member 14 arranged to cover an outer circumference of the housing 12. Similarly, the receptacle connector 60 mainly includes the contact members (the terminal members) 70; a housing 62 with insulation property for holding the contact members 70; and a metal shell member 64 arranged to cover an outer circumference of the housing 62.

In the embodiment, the plug connector 10 further includes a fitting portion 13, and the receptacle connector 60 further includes a receptacle opening portion 63. When the fitting portion 13 of the plug connector 10 is inserted into an inside of the receptacle connector 60 through the receptacle opening portion 63 of the receptacle connector 60 along the fitting direction B, the plug connector 10 is fitted into and connected to the receptacle connector 60.

In the embodiment, when the plug connector 10 is fitted into and connected to the receptacle connector 60, the contact members 11 disposed in the plug connector 10 contact with the contact members 70 disposed in the receptacle connector 60. When the contact members 11 contact with the contact members 70, the electrical cables 20 connected to the plug connector 10 are electrically connected to a wiring portion of the board. Further, the metal shell member 14 of the plug connector 10 contacts with the metal shell member 64 of the receptacle connector 60, thereby making it possible to increase the shielding effect thereof.

In the embodiment, the metal shell member 14 of the plug connector 10 is formed of an upper shell member 14A for covering an upper portion of the housing 12 and a lower shell member 14B for covering a lower portion of the housing 12. A holding portion 15 is formed of the upper shell member 14A and the lower shell member 14B at both end portions of the plug connector 10 in the longitudinal direction A thereof. The holding portion 15 is provided for supporting a rotational pull bar (not shown).

Figure 4:
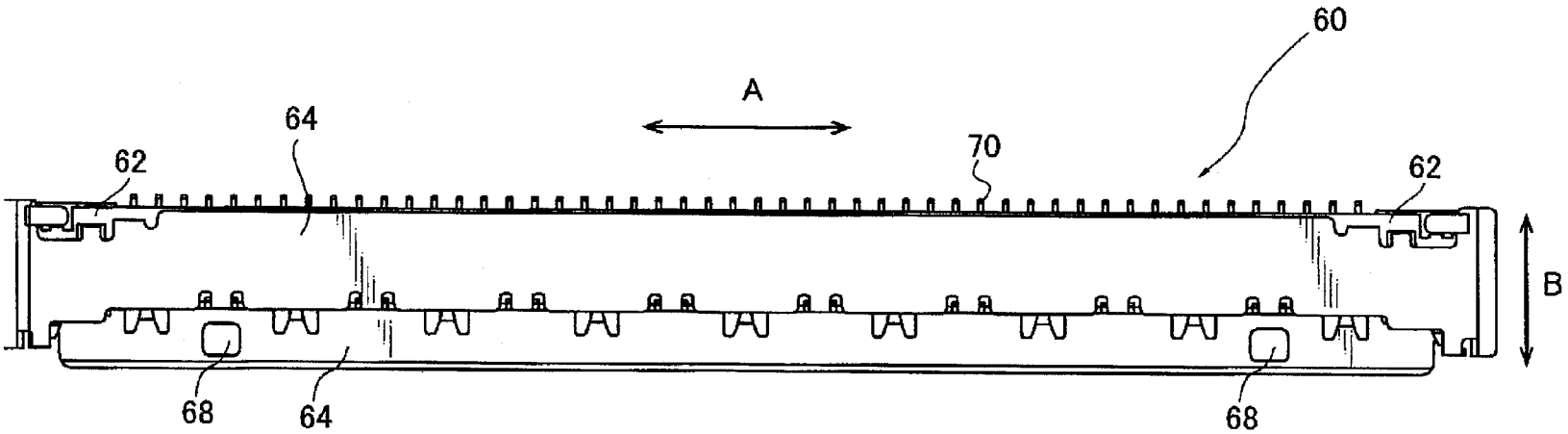
FIG. 4 is a plan view showing the receptacle connector according to the embodiment of the present invention.
Figure 5:
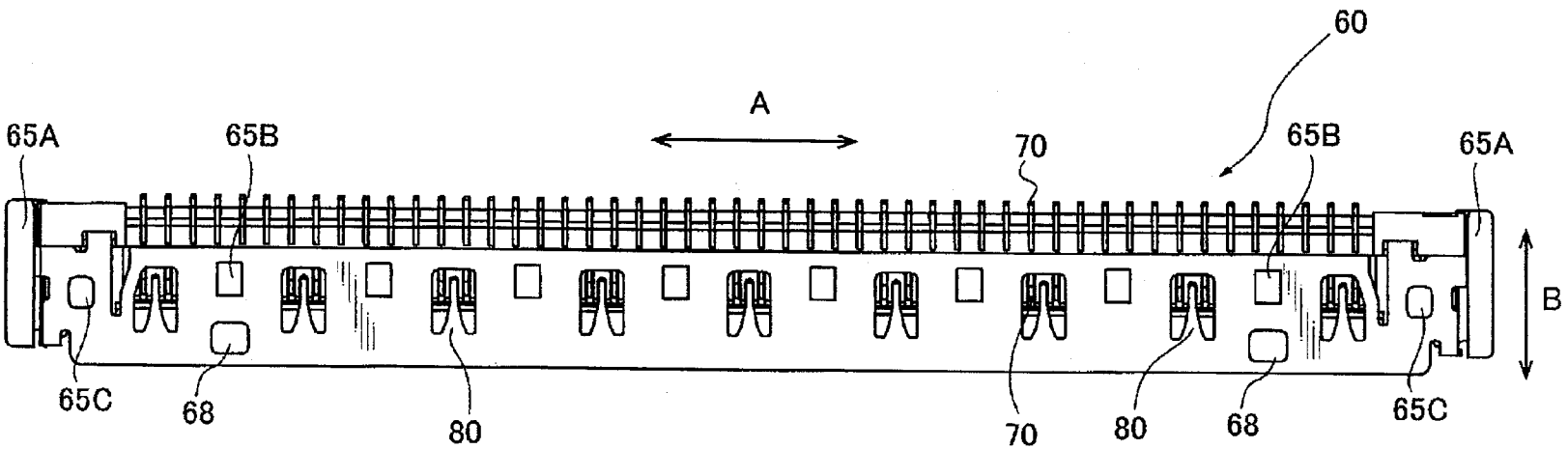
FIG. 5 is a bottom view showing the receptacle connector viewed from the side of the board according to the embodiment of the present invention.
Figure 6:
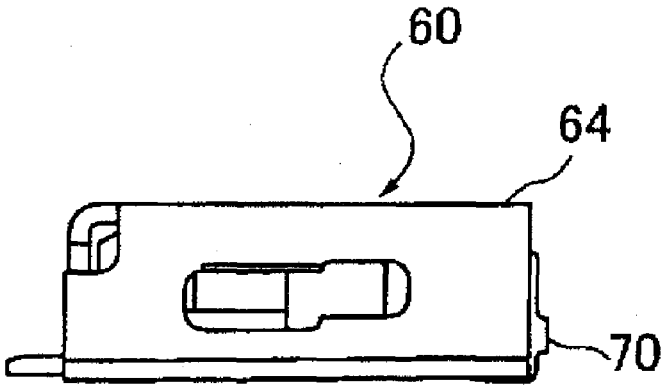
FIG. 6 is a right side view showing the receptacle connector according to the embodiment of the present invention.
Figure 7:
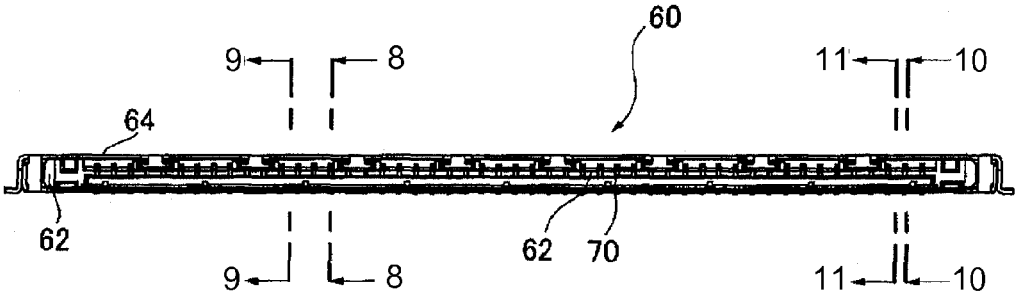
FIG. 7 is a front view showing the receptacle connector viewed from a side of an receptacle opening portion of the receptacle connector according to the embodiment of the present invention.

Next, the configuration of the plug connector 10 will be explained in more detail with reference to FIGS. 4 to 11. FIG. 4 is a plan view showing the receptacle connector 60 according to the embodiment of the present invention. FIG. 5 is a bottom view showing the receptacle connector 60 viewed from the side of the board according to the embodiment of the present invention. FIG. 6 is a right side view showing the receptacle connector 60 according to the embodiment of the present invention. FIG. 7 is a front view showing the receptacle connector 60 viewed from a side of the receptacle opening portion 63 of the receptacle connector 60 according to the embodiment of the present invention.

Figure 8:
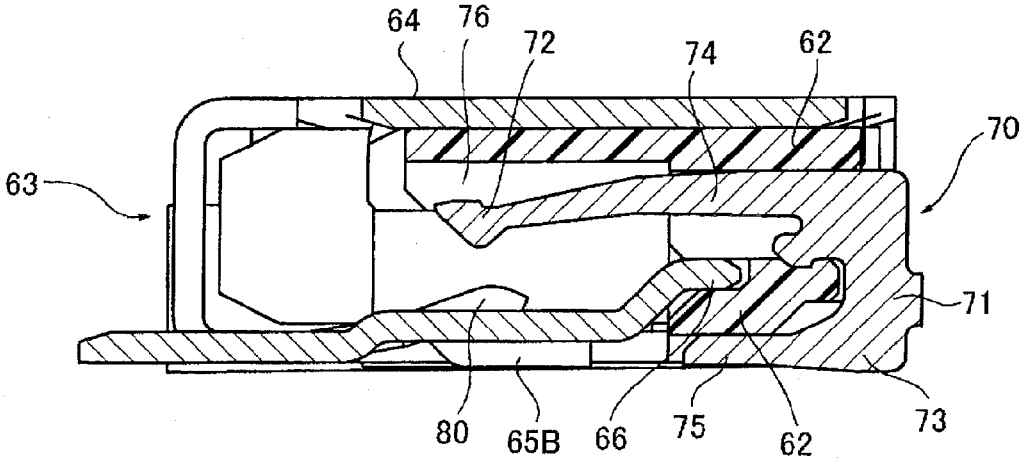
FIG. 8 is a sectional view showing the receptacle connector taken along a line 8-8 in FIG. 7 according to the embodiment of the present invention.
Figure 9:
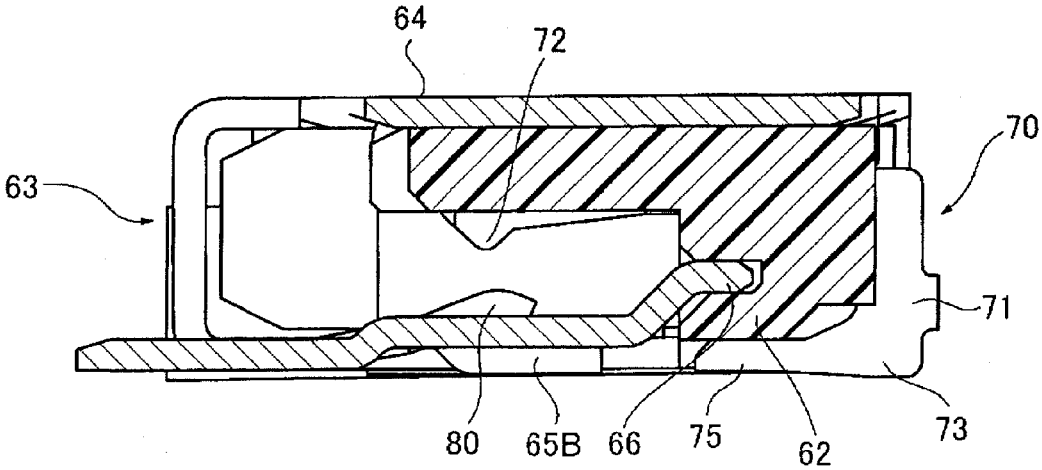
FIG. 9 is a sectional view showing the receptacle connector taken along a line 9-9 in FIG. 7 according to the embodiment of the present invention.
Figure 10:
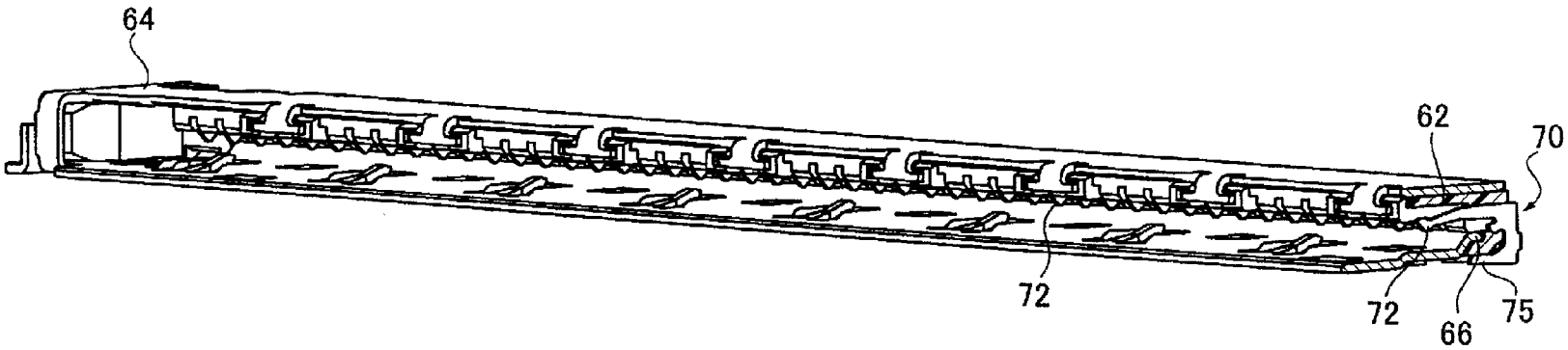
FIG. 10 is a sectional perspective view showing the receptacle connector taken along a line 10-10 in FIG. 7 according to the embodiment of the present invention.
Figure 11:
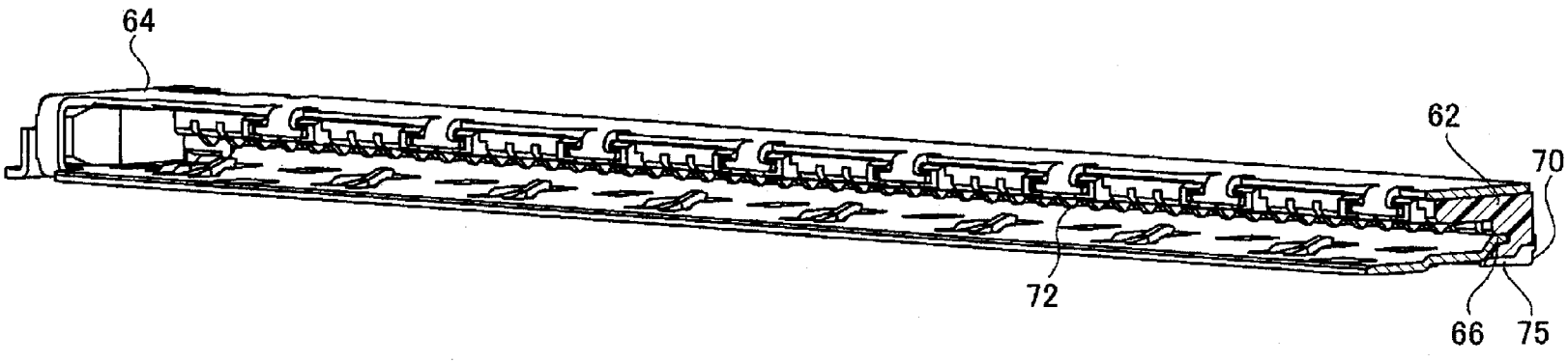
FIG. 11 is a sectional perspective view showing the receptacle connector taken along a line 11-11 in FIG. 7 according to the embodiment of the present invention.

Further, FIG. 8 is a sectional view showing the receptacle connector 60 taken along a line 8-8 in FIG. 7 according to the embodiment of the present invention. FIG. 9 is a sectional view showing the receptacle connector 60 taken along a line 9-9 in FIG. 7 according to the embodiment of the present invention. FIG. 10 is a sectional perspective view showing the receptacle connector 60 taken along a line 10-10 in FIG. 7 according to the embodiment of the present invention. FIG. 11 is a sectional perspective view showing the receptacle connector 60 taken along a line 11-11 in FIG. 7 according to the embodiment of the present invention.

In the embodiment, the metal shell member 64 of the receptacle connector 60 may be produced through punching out one single metal plate and bending the metal plate. As shown in FIG. 5, a solder attaching portion 65A is disposed at each of right and left end portions of a bottom surface of the metal shell member 64. The solder attaching portion 65A is produced through bending the end portion of the metal shell member 64. When the receptacle connector 60 is mounted on the print circuit board, the solder attaching portion 65A is attached to the print circuit board with solder, so that the solder attaching portion 65A is connected to ground through the connection with the print circuit board.

As shown in FIG. 5, the metal shell member 64 further includes a solder attaching portion 65B and a ground connecting portion 65B similar to the solder attaching portion 65A. In addition, the metal shell member 64 includes a ground contacting section 80 and an easy lock hole 68. When an engaging portion (not shown) on the side of the plug connector 10 engages with the easy lock hole 68, the plug connector 10 can be easily attached to the receptacle connector 60.

In the embodiment, the solder attaching portion 65C is disposed at each of right and left end portions of the bottom surface of the metal shell member 64, that is, the surface of the metal shell member 64 facing the print circuit board. The solder attaching portion 65C is produced through bending a part of the bottom surface of the metal shell member 64 toward the print circuit board. It is noted that the solder attaching portion 65C is bent toward the print circuit board, so that the solder attaching portion 65C easily contacts with the print circuit board relative to other surrounding surface, thereby making it easy to attach the solder attaching portion 65C to the print circuit board with solder.

Similar to the solder attaching portion 65A, when the receptacle connector 60 is mounted on the print circuit board, the solder attaching portion 65C is attached to the print circuit board with solder, so that the solder attaching portion 65C is connected to ground through the connection with the print circuit board.

In the embodiment, similar to the solder attaching portion 65C, the ground connecting portion 65B is produced through bending a part of the bottom surface of the metal shell member 64 toward the print circuit board. When the receptacle connector 60 is mounted on the print circuit board, the ground connecting portion 65B is attached to the print circuit board with solder, so that the ground connecting portion 65B is connected to ground through the connection with the print circuit board.

As described above, in the embodiment, the metal shell member 64 is attached to the print circuit board with solder at a plurality of locations, that is, the solder attaching portion 65A, the ground connecting portion 65B, and the solder attaching portion 65C. Accordingly, it is possible to firmly mount the receptacle connector 60 on the print circuit board.

As shown in FIG. 5, the metal shell member 64 includes ground contacting sections 80. The ground contacting sections 80 are produced through bending a part of the bottom surface of the metal shell member 64 facing the print circuit board toward inside the receptacle connector 60 in a cantilever shape. The ground contacting sections 80 are configured to be capable of deforming in a vertical direction. When the fitting portion 13 of the plug connector 10 is inserted into the receptacle connector 60, the ground contacting sections 80 contact with the metal shell member 14 of the plug connector 10, especially the lower shell member 14B through elastic connection or ground connection. At the same time, the contact members 70 contact with the contact members 11 of the plug connector 10 (refer to FIG. 1) at contact sections 72 thereof (refer to FIG. 8). It should be noted that the contact members 70 are connected to the wiring portion of the print circuit board at board connecting section 73 thereof as lower end portions thereof (refer to FIG. 8).

As shown in FIGS. 8 to 11, each of the contact members (the terminal members) of the receptacle connector 60 includes a base portion 71 to be tightly fitted in and fixed to the housing 62; an arm portion 74 extending from one side (an upper side) of the base portion 71 toward the receptacle opening portion 63; the contact section 72 formed in a protruded shape and situated at a distal end portion of the arm portion 74; a board connecting portion 73 situated on the other side (a lower side) of the base portion 71; and a rotation preventing portion 75 extending from the board connecting portion 73 toward the receptacle opening portion 63.

In the embodiment, the contact members 70 are formed of a metal material with electrical conductivity, and the board connecting portions 73 are configured to be soldered to the wiring portion of the print circuit board. When the plug connector 10 is connected to the receptacle connector 60, the contact sections 72 are arranged to contact with upper portions of the contact members 11 of the plug connector 10. In addition to the board connecting portions 73, the rotation preventing portions 75 may be configured to be soldered to the wiring portion of the print circuit board. Further, in addition to the soldering, the board connecting portions 73 or the rotation preventing portions 75 may be configured to be electrically connected to the wiring portion of the print circuit board with other method such as a conductive adhesive and a conductive paste.

In the embodiment, as shown in FIG. 8, a space 76 is formed above the contact section 72 of the contact member 70. Accordingly, when the contact section 72 contacts with the contact member 11 of the plug connector 10, the contact section 72 can be deformed upwardly.

In the embodiment, the metal shell member 64 of the receptacle connector 60 includes a shell receiving portion 66 at a bottom portion (on the side of the print circuit board) of the metal shell member 64. The shell receiving portion 66 extends from the side of the receptacle opening portion 63 toward the base portions 71 of the contact members 70. Further, the metal shell member 64 extends over an entire portion of the receptacle connector 60 in the longitudinal direction A thereof. A distal end portion of the shell receiving portion 66 is configured to be fitted into the housing 62.

As shown in FIGS. 8 and 9, the shell receiving portion 66 is disposed between the contact section 72 and the arm portion 74 of the contact member 70 and the rotation preventing portion 75. Further, a portion (an insertion portion) of the housing 62 is tightly fitted between the shell receiving portion 66 and the rotation preventing portion 75. In other words, the part of the housing 62 is filled in between the shell receiving portion 66 and the rotation preventing portion 75.

In the embodiment, it is preferred that the shell receiving portion 66 is arranged to partially overlap with the rotation preventing portion 75 when viewed from above.

In such an arrangement, the distal end portion of the shell receiving portion 66 is curved upwardly in a crank shape as shown in FIG. 8, so that the distal end portion of the shell receiving portion 66 does not contact with the rotation preventing portion 75. In other words, the distal end portion (a free end portion) of the shell receiving portion 66 is situated closer to the base portion 71 relative to a distal end portion (a free end portion) of the rotation preventing portion 75. Further, the distal end portion (the free end portion) of the shell receiving portion 66 is situated closer to the arm portion 74 relative to the distal end portion (a free end portion) of the rotation preventing portion 75.

In the embodiment, the metal shell member 64 may not be arranged to extend over the entire portion of the receptacle connector 60 in the longitudinal direction A thereof. Alternatively, the metal shell member 64 may be arranged to extend over a plurality of or all of the contact members 70 in the longitudinal direction A of the receptacle connector 60.

As described above, when the fitting portion 13 of the plug connector 10 is fitted into the receptacle opening portion 63 of the receptacle connector 60, the contact sections 72 disposed at the distal end portions of the arm portions 74 of the contact members 70 contact with the upper surface contact portions of the contact members 11 of the plug connector 10. At this moment, the arm portions 74 of the contact members 70 are deformed upwardly, so that the upper rotational moment is generated in the base portions 71 of the contact members 70. When the upper rotational moment is generated, the contact members 70 may be rotated.

In the receptacle connector 60 in the embodiment, the rotation preventing portions 75 contact with the lower side of the portion (the insertion portion) of the housing 62, and the shell receiving portion 66 contacts with the upper side of the portion (the insertion portion) of the housing 62. With such a configuration, it is possible to absorb the upper rotational moment. As a result, when the plug connector 10 is connected to the receptacle connector 60, it is possible to prevent the contact members 70 from being rotated relative to the print circuit board. Accordingly, it is possible to prevent poor electrical connection due to damage in the soldered portion of the board connecting portion 73.

Further, in the receptacle connector 60 in the embodiment, it is possible to prevent the thickness of the receptacle connector 60 from being increased due to the rotation of the contact members 70. Accordingly, it is possible to reduce the thickness of the receptacle connector 60 and improve the reliability of the receptacle connector 60.

As described above, the embodiment of the present invention is explained. It should be noted that the present invention is not limited to the embodiment described above, and may be modified within the scope of the present invention.

For example, in the embodiment described above, the plug connector 10 is the cable side connector, and the electrical cables 20 are connected to the plug connector 10. The present invention is not limited to the configuration, and it is not necessary to connect the electrical cables 20 to the plug connector 10. Further, the electrical cables 20 may be connected to the receptacle connector 60.

The disclosure of Japanese Patent Application No. 2011-257070 filed on Nov. 25, 2011, is incorporated in the application by reference.

While the invention has been explained with reference to the specific embodiments of the invention, the explanation is illustrative and the invention is limited only by the appended claims.

What is claimed is:

1. An electrical connector to be mounted on a board, comprising:

a housing having a receptacle opening portion for receiving a mating connector;

a terminal member disposed in the housing; and a shell member for covering the housing, wherein said terminal member includes a base portion fixed to the housing, an arm portion extending from the base portion toward the receptacle opening portion, a contact portion disposed at a distal end portion of the arm portion, a board connecting portion, and a rotation preventing portion extending from the board connecting portion toward the receptacle opening portion, said board connecting portion is configured to be soldered to the board, said shell member includes a shell receiving portion extending toward the base portion, said shell receiving portion is situated between the contact portion and the rotation preventing portion, and said housing includes an insertion portion disposed between the rotation preventing portion and the shell receiving portion.

2. The electrical connector according to claim 1, wherein said shell receiving portion has a distal end portion situated closer to the base portion and the arm portion relative to a distal end portion of the rotation preventing portion.

3. The electrical connector according to claim 1, wherein said shell receiving portion is arranged to cover the terminal member and an adjacent terminal member situated adjacent to the terminal member along a longitudinal direction of the electrical connector.

4. The electrical connector according to claim 1, wherein said shell receiving portion is arranged to cover the terminal member and all other terminal members arranged together with the terminal member along a longitudinal direction of the electrical connector.

5. The electrical connector according to claim 1, wherein said rotation preventing portion is configured to be soldered to the board.

6. The electrical connector according to claim 1, wherein said rotation preventing portion is configured to be overlapped with the insertion portion in a vertical direction.

7. The electrical connector according to claim 1, wherein said rotation preventing portion is configured to directly contact with the insertion portion.

* * * * *